US006937124B1

(12) United States Patent
Nakamura et al.

(10) Patent No.: US 6,937,124 B1
(45) Date of Patent: Aug. 30, 2005

(54) PLANE PLATE VIBRATION DEVICE AND SWITCH EMPLOYING THE SAME

(75) Inventors: Akio Nakamura, Shinagawa (JP); Satoshi Sakurai, Shinagawa (JP); Shigemi Kurashima, Shinagawa (JP); Nobuo Yatsu, Shinagawa (JP); Shinichiro Akieda, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 11/052,768

(22) Filed: Feb. 9, 2005

(30) Foreign Application Priority Data

Feb. 13, 2004 (JP) ..... 2004-037409

(51) Int. Cl.[7] ..... H01F 7/08
(52) U.S. Cl. ..... 335/222; 340/407.2; 345/173
(58) Field of Search ..... 335/177–183, 335/222–224; 340/407.1–407.2; 345/173–178

(56) References Cited

U.S. PATENT DOCUMENTS 6,816,049 B2 * 11/2004 Watanabe et al. ..... 335/222
2004/0178996 A1 * 9/2004 Kurashima et al. ..... 345/173

FOREIGN PATENT DOCUMENTS

JP 6-7408 1/1994
JP 2003-122507 4/2003

* cited by examiner

*Primary Examiner*—Ramon M. Barrera
(74) *Attorney, Agent, or Firm*—Staas & Halsey LLP

(57) ABSTRACT

A plane plate vibration device includes a plane plate, a coil portion having a first coil and a second coil, the first coil being wound on a circumference of the plane plate in parallel with the plane plate, the second coil being wound along inside of the first coil in parallel with the plane plate, and magnetic field generating mechanisms that are provided in parallel with the plane plate and generate magnetic fields in directions perpendicular to directions of currents respectively flowing through the first coil and the second coil. The currents flow through the first coil and the second coil in reverse directions, the directions of magnetic fields perpendicular to the currents respectively flowing through the first coil and the second coil give forces in the same direction, and the plane plate vibrates in a direction of thickness by adjusting the currents respectively flowing through the first coil and the second coil.

24 Claims, 11 Drawing Sheets

PLANE PLATE VIBRATION DEVICE AND SWITCH EMPLOYING THE SAME

BACKGROUND OF THE INVENTION

1. Field of the Invention

This invention generally relates to an input device such as a touch panel, switch, or the like. The touch panel is used for detecting coordinates of a position pushed by, for example, a pen, a finger, or the like, and the input device is used for detecting a position inputted by a finger or the like.

2. Description of the Related Art

Conventionally, panel-shaped input devices named touch panel input device and touch pad input device have been proposed. The touch panel input device includes a display overlapping a touch sensor. The touch pad is used with a personal computer. Information to the above-mentioned panel-shaped input devices is generated by touching a position that corresponds to, for example, buttons displayed on a screen with an attached pen or by touching inside an operation range at certain intervals.

In the case where the above-mentioned panel-shaped input devices, are used as an input switch, a plane switch such as a touch panel does not give a feeling of click as if a mechanical switch were pushed down. This is a drawback in that a user cannot recognize a pushdown.

Japanese Patent Application Publication No. 2003-122507 (hereinafter referred to as Document 1) discloses a touch panel input device in order to solve the aforementioned drawback. FIG. 1 is a perspective view of a conventional touch panel input device. Referring to FIG. 1, a touch panel input device 1 includes a piezoelectric substrate 2. The piezoelectric substrate 2 is arranged between an upper movable plate 3 and a lower supporting substrate 4. The piezoelectric substrate 2 is conducted, when a movable conductive material layer 6 touches a fixed conductive material layer 7 according to an input from a touch panel. The piezoelectric substrate 2 expands and contracts to apply vibrations to the movable plate 3. Japanese Patent Application Publication No. 6-7408 (hereinafter referred to as Document 2) discloses a device that gives a sense of touch. FIG. 2 is a cross-sectional view of the device that gives the sense of touch. Referring to FIG. 2, the device 10, which gives the sense of touch, includes a protruded surface 11, a vibration plate 12, a movable coil 13, a connecting chassis 14, and a magnet 15. The vibration plate 12 is vibrated by an electromagnetic force generated between the movable coil 13 and the magnet 15. The sense of touch is given to a finger, when the finger touches the protruded surface 11.

The touch panel input device disclosed in Document 1, however, the upper movable plate 3 and the lower supporting substrate 4 are normally configured to integrate due to a bonded structure, although the piezoelectric substrate 2 is arranged between the upper movable plate 3 and the lower supporting substrate 4 so as to vibrate the upper movable plate 3. This bonding structure makes it impossible to provide a sufficient gap between the upper movable plate 3 and the lower supporting substrate 4. That is to say, the upper movable plate 3 cannot retain a sufficient amount of mechanical displacement. This makes it impossible to give the feeling of click, when the panel is pushed down.

The device giving the sense of touch disclosed in Document 2 includes the protruded surface 11 on a top face of the vibration plate 12. There is a problem in that the device disclosed in Document 2 cannot be used as the input device, because it is hard to recognize a display device or electric decoration, if the display device or electric decoration is provided on a backside of the protruded surface 11.

SUMMARY OF THE INVENTION

The present invention has been made in view of the above circumstances and provides a plane plate vibration device that can apply vibrations of large strokes to a plane plate with coils and magnetic field generating mechanisms.

According to an aspect of the present invention, preferably, there is provided a plane plate vibration device including a plane plate, a coil portion having a first coil and a second coil, the first coil being wound on a circumference of the plane plate in parallel with the plane plate, the second coil being wound along inside of the first coil in parallel with the plane plate, and magnetic field generating mechanisms that are provided in parallel with the plane plate and generate magnetic fields in directions perpendicular to directions of currents respectively flowing through the first coil and the second coil. The currents flow through the first coil and the second coil in reverse directions, the directions of magnetic fields perpendicular to the currents respectively flowing through the first coil and the second coil give forces in the same direction, and the plane plate vibrates in a direction of thickness by adjusting the currents respectively flowing through the first coil and the second coil. With the above-mentioned configuration, the first coil and the second coil provided on a plane plate are moved so that the forces may be applied to the same direction. It is thus possible to give a vibration of large stroke on the plane plate.

According to an aspect of the present invention, preferably, there is provided a touch panel including a plane plate outputting a signal indicating coordinates of a touched position, a coil portion having a first coil and a second coil, the first coil being wound on a circumference of the plane plate in parallel with the plane plate, the second coil being wound along inside of the first coil in parallel with the plane plate, and magnetic field generating mechanisms that are provided in parallel with the plane plate and generate magnetic fields in directions perpendicular to directions of currents respectively flowing through the first coil and the second coil, the currents flow through the first coil and the second coil in reverse directions, the directions of magnetic fields perpendicular to the currents respectively flowing through the first coil and the second coil give forces in the same direction, and the plane plate vibrates in a direction of thickness by adjusting the currents respectively flowing through the first coil and the second coil.

According to an aspect of the present invention, preferably, there is provided a switch including a plane plate, a coil portion having a first coil and a second coil, the first coil being wound on a circumference of the plane plate in parallel with the plane plate, the second coil being wound along inside of the first coil in parallel with the plane plate, magnetic field generating mechanisms that are provided in parallel with the plane plate and generate magnetic fields in directions perpendicular to directions of currents respectively flowing through the first coil and the second coil, and a sensor sensing a touch of an object. The currents flow through the first coil and the second coil in reverse directions, the directions of magnetic fields perpendicular to the currents respectively flowing through the first coil and the second coil give forces in the same direction, and the plane plate is vibrated in a direction of thickness in response to the touch sensed by the sensor.

BRIEF DESCRIPTION OF THE DRAWINGS

Preferred embodiments of the present invention will be described in detail with reference to the following drawings, wherein.

DESCRIPTION OF THE PREFERRED EMBODIMENTS

A description will now be given, with reference to the accompanying drawings, of an embodiment of the present invention.

First Embodiment

Figure 1:
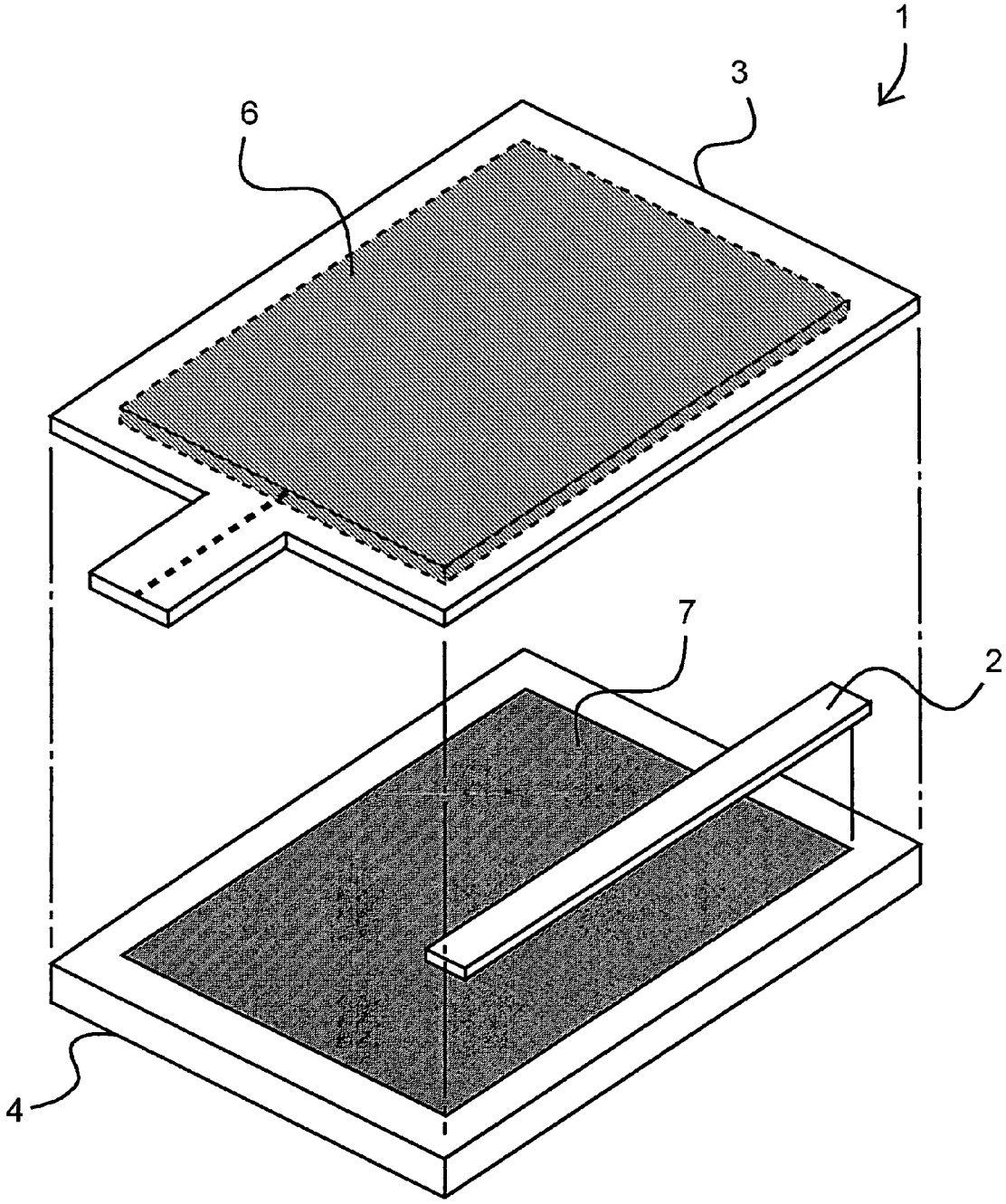
PRIOR ART FIG. 1
FIG. 1 is a perspective view of a conventional touch panel input device.
Figure 2:
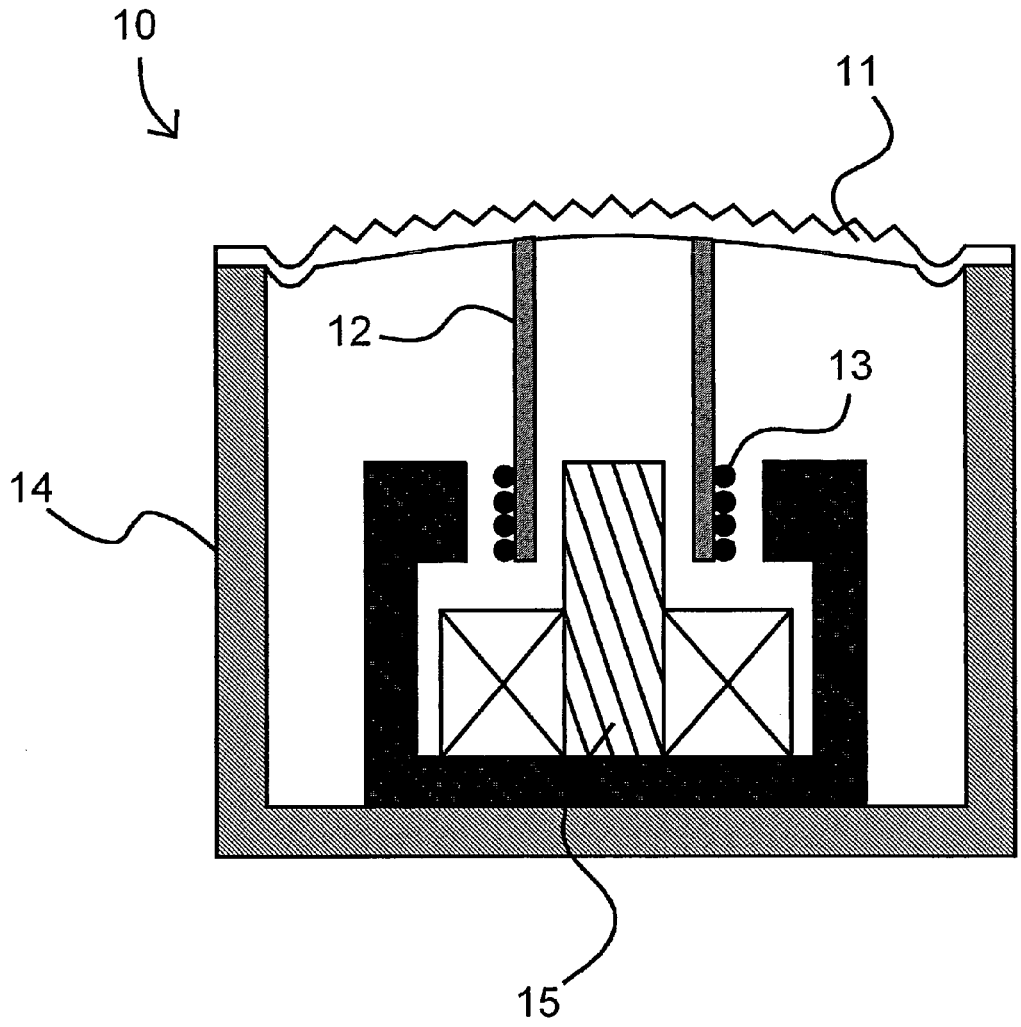
PRIOR ART FIG. 2
FIG. 2 is a cross-sectional view of a device that gives a sense of touch.
Figure 3A:
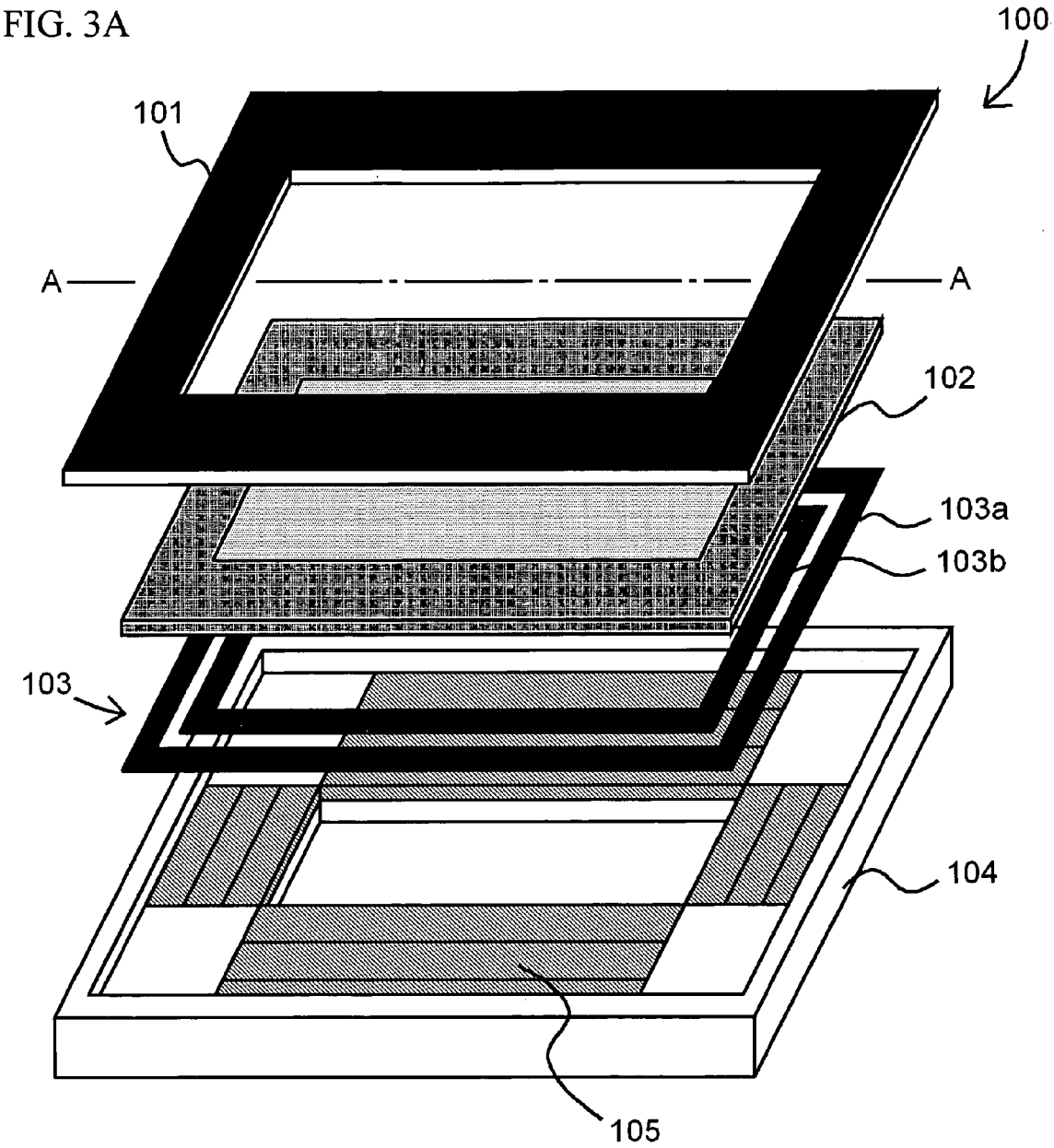
FIG. 3A is a perspective view of a laminated structure of a plane plate vibration device in accordance with a first embodiment of the present invention.
Figure 3B:
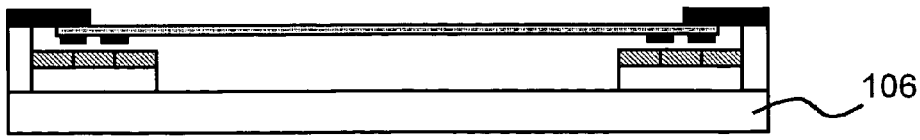
FIG. 3B is a cross-sectional view taken along a line A—A shown in FIG. 3A.

A description will be given of a first embodiment of the present invention, with reference to drawings. FIG. 3A is a perspective view of a laminated structure of a plane plate vibration device in accordance with the first embodiment of the present invention. FIG. 3B is a cross-sectional view taken along a line A—A shown in FIG. 3A. A plane plate vibration device 100 includes a fixing member 101, a touch panel 102, a coil portion 103 having a first coil 103*a* and a second coil 103*b*, and a frame-shaped base 104. The fixing member 101 has a shape of substantially rectangular frame, is made of an elastic body such as rubber, and has an opening in the center to secure a circumference portion thereof excluding an input surface of the touch panel 102. The fixing member 101 may be divided and arranged partially on the circumference portion of the touch panel 102. Referring to FIG. 3B, the circumference portion on the top face of the touch panel 102 is bonded together with a bottom face of the fixing member 101 by, for example, an adhesive or two-sided tape. The first coil 103*a* is wound in a substantially rectangular circle. The second coil 103*b* wound in a substantially rectangular circle is provided inside the first coil 103*a*. The coil portion 103 is arranged along the circumference portion of the touch panel 102. As shown in FIG. 3B, the coil portion 103 is secured to the touch panel by, for example, a bonding method. The frame-shaped base 104 includes multiple magnetic field generating mechanisms 105. The magnetic field generating mechanisms 105 are arranged just below the coil portion 103 provided inside the frame-shaped base 104. A display device 106 such as a liquid crystal panel, plasma display, or the like is provided under a bottom face of the frame-shaped base 104 so that the user can look at images and characters displayed on the display device 106 through the top face of the touch panel 102. Further, a cover (not shown) is laminated on a top face of the fixing portion 101, according to a product to which the plane plate vibration device is attached.

Figure 4A:
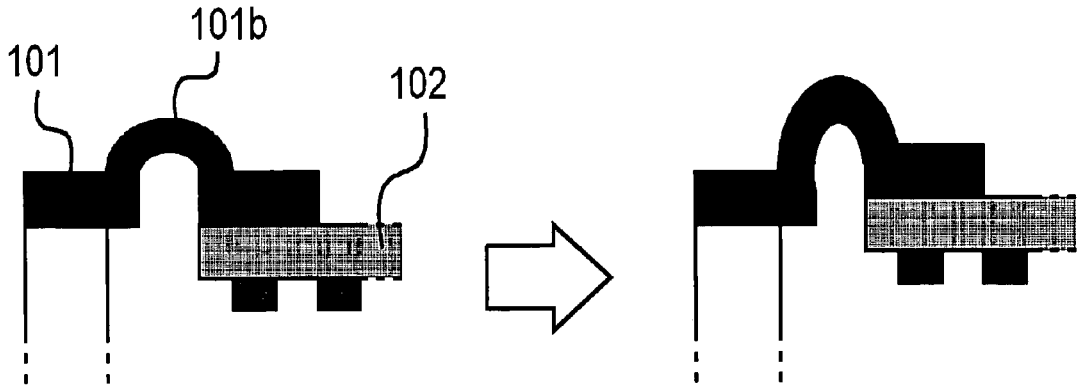
FIGS. 4A and 4B are cross-sectional views of parts of variation examples of the plane plate vibration device shown in FIGS. 3A and 3B.
Figure 4B:
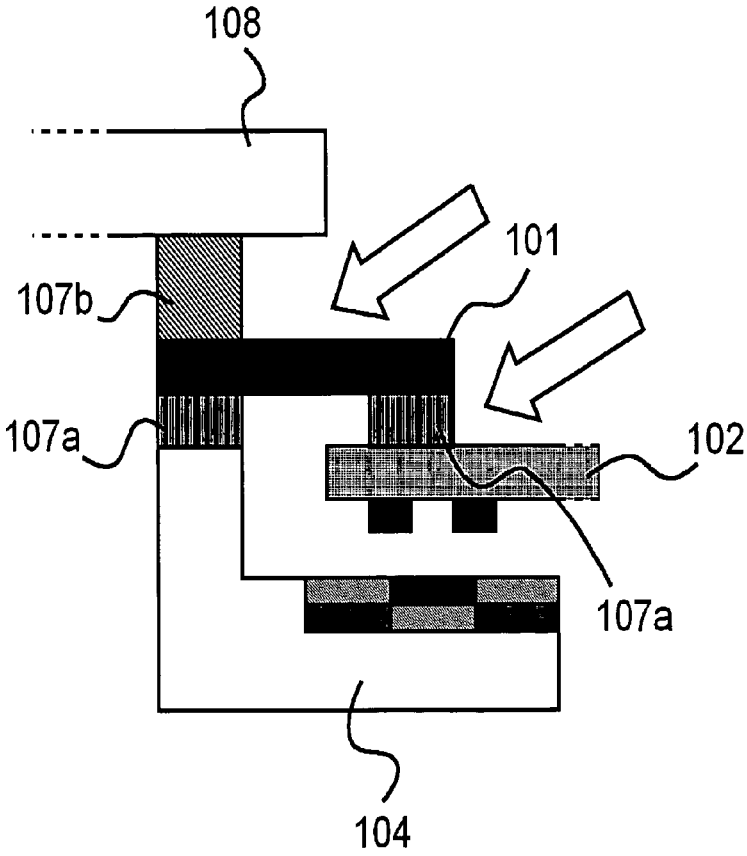

FIGS. 4A and 4B are cross-sectional views of parts of variation examples of the plane plate vibration device shown in FIGS. 3A and 3B. Referring to FIG. 4A, the fixing member 101 may include a protruded convex portion 101*b* in the center of the substantially rectangular frame. The protruded convex portion 101*b* makes it possible to give a large amount of displacement with a small power or stress generated when the touch panel 102 moves up and down, as compared to a plane surface. Referring to FIG. 4B, the fixing portion 101 may be bonded respectively with the touch panel 102 and the frame-shaped base 104 by a water-resistant adhesive 107*a* such as a silicon-based adhesive or the like. The fixing portion 101 may be secured to a cover 108 that covers the whole device with a water-resistant elastic material 107*b* such as a silicon rubber or the like. With the above-mentioned configuration, even if impurities such as water or dust is attached from the outside of the plane plate vibration device 100 or the input surface of the touch panel 102, the impurities can be prevented from getting into the back side of the touch panel 102, on which the coil portion 103 and the magnetic field generating mechanism 105 are provided.

Figure 5A:
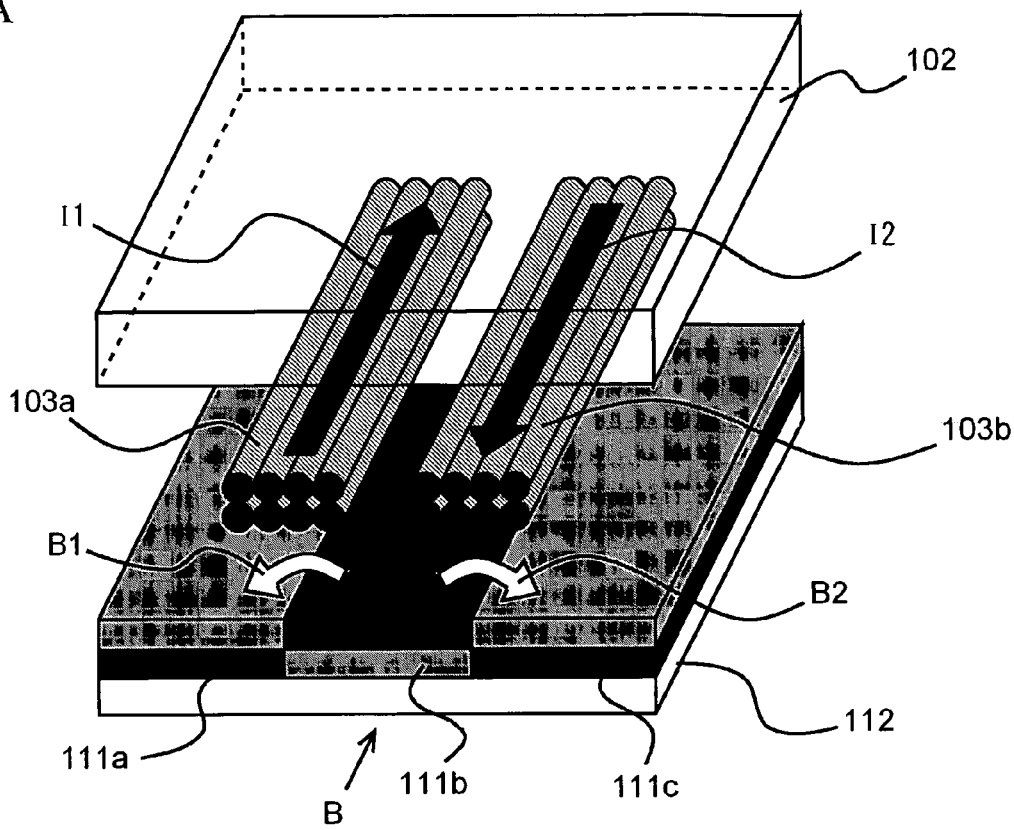
FIGS. 5A through 5C are views describing the principle of operation of a touch panel and a coil portion in accordance with the first embodiment of the present invention.
Figure 5B:
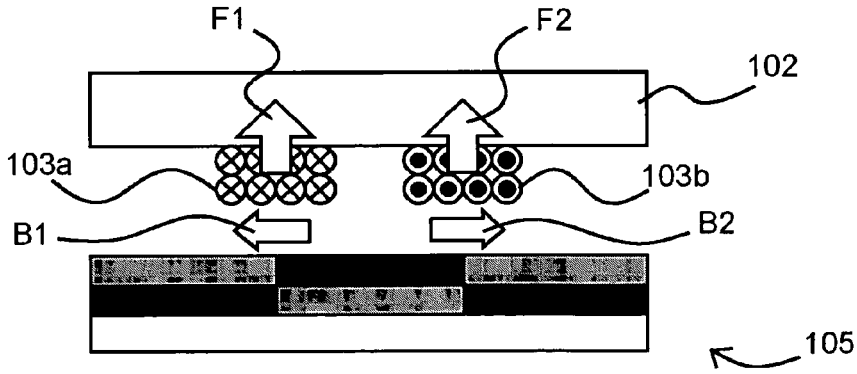
Figure 5C:
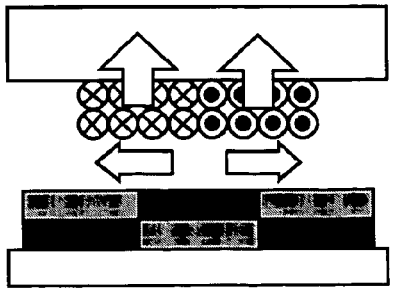

Next, a description will be given of a positional relationship and operation of the coil portion 103 and the magnetic field generating mechanism 105. FIGS. 5A through 5C show arrangements of parts of the coil portion 103 and the magnetic field generating mechanism 105 in accordance with the first embodiment of the present invention. As described above, the coil portion 103 is adhered in the proximity of the circumference on the back face of the touch panel 102, along the circumference thereof. The coil portion 103 includes the first coil 103*a* and the second coil 103*b*. Referring to FIG. 5A, currents I1 and I2 having different directions are respectively applied to the first coil 103*a* and the second coil 103*b*. The magnetic field generating mechanism 105 includes a first magnet 111*a*, a second magnet 111*b*, a third magnet 111*c*, and a yoke 112, on which the above-mentioned three magnets 111*a*, 111*b*, and 111*c* are secured. The three magnets 111*a*, 111*b*, and 111*c* are secured on the yoke 112 by, for example, a bonding method so that pole faces arranged on top faces may alternately be different. In FIGS. 5A through 5C, South Pole of the first magnet 111*a*, North Pole of the second magnet 111*b*, and South Pole of the third magnet 111*c* are respectively arranged to show the top faces thereof. Preferably, the yoke 112 is made of a magnetic material. With the above-mentioned configuration, magnetic fields are generated in the directions of arrows B1 and B2. The generated magnetic fields form closed loops passing through the yoke 112 and thus suppress the dissipation of the magnetic fields.

Referring to FIG. 5B, a gap is provided between the coil portion 103 and the magnetic field generating mechanism 105 so that the touch panel 102 may not touch directly when the touch panel 102 vibrates. An interface between the first magnet 111*a* and the second magnet 111*b* and another interface between the second magnet 111*b* and the third magnet 111*c* are respectively arranged just below a substantial center of the first coil 103*a* and that of the second coil 103*b*. With the above-mentioned arrangement, magnetic fields B1 and B2 are respectively applied to the current I1 flowing through the first coil 103*a* and the current I2 flowing through the first coil 103*b*. The magnetic fields B1 and B2 have reverse directions each other and are perpendicular to the directions of the currents I1 and 12. Here, forces are respectively applied to the first coil 103*a* and the second coil 103*b* in the directions of arrows F1 and F2, according to the Fleming's law. The forces are applied to the touch panel 102 upward in FIG. 5C, and the touch panel 102 is lifted up. In the case where the directions of the currents I1 and I2 flowing through the first coil 103*a* and the second coil 103*b* are reversed, the forces are applied to the touch panel 102 downward, and the touch panel 102 is lifted down. In this manner, the currents flowing through the coils are controlled so as to generate the upward and downward forces. It is thus possible to give a desired upward and downward vibration to the touch panel 102.

Referring to FIG. 5B, the first coil 103*a* and the second coil 103*b* may be attached firmly to the touch panel 102. In this case, a gap from the interface between the first magnet 111*a* and the second magnet 111*b* to the interface between the second magnet 111*b* and the third magnet 111*c* becomes narrower, according to the distance between the first coil 103*a* and the second coil 103*b*. It is thus possible to make the width of the magnets small, the magnets being included in the multiple magnetic field generating mechanisms 105, and the whole area of the multiple magnetic field generating mechanisms 105 can be decreased.

Figure 6A:
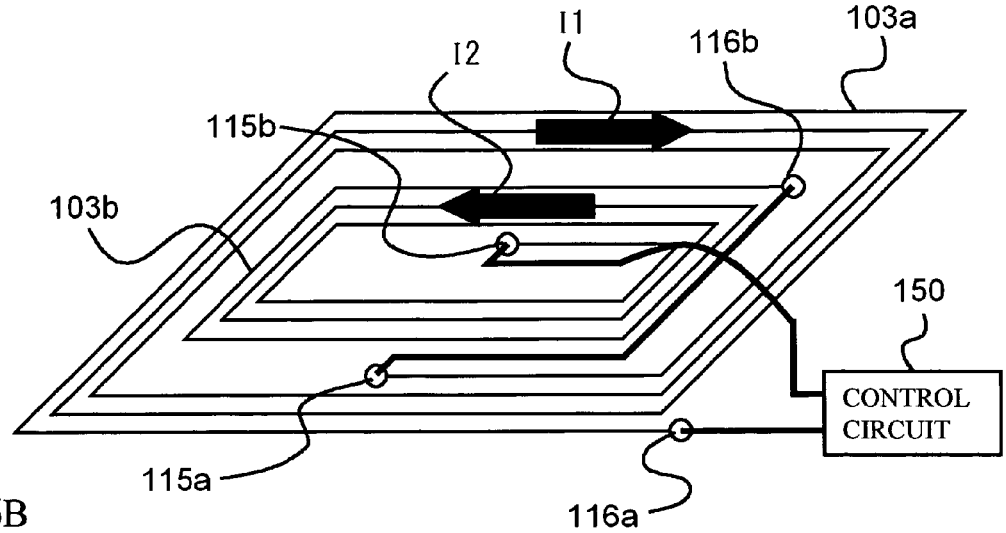
FIGS. 6A through 6C are perspective views describing how the current is applied to the coil portion 103 in accordance with the first embodiment of the present invention.
Figure 6B:
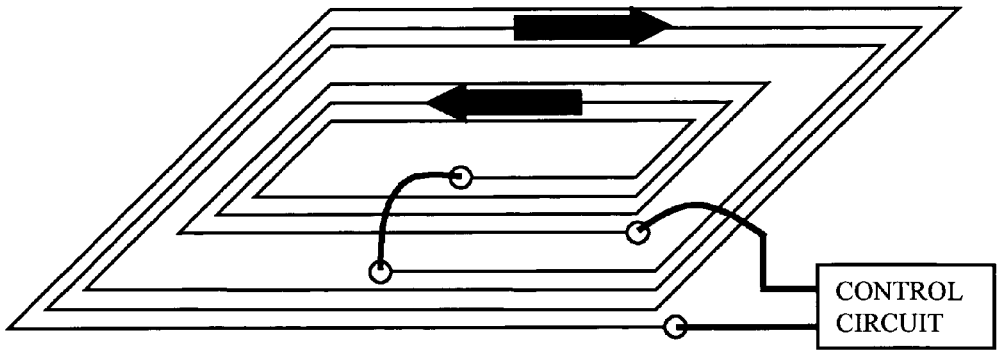
Figure 6C:
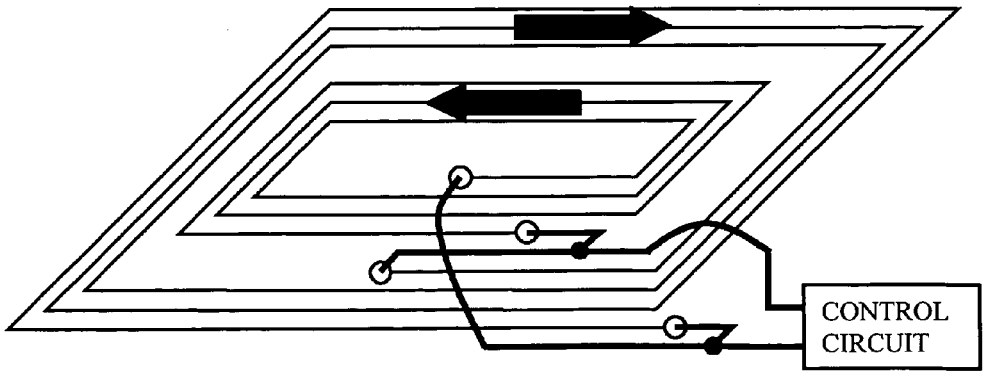

FIGS. 6A through 6C are perspective views describing how the current is applied to the coil portion 103 in accordance with the first embodiment of the present invention. The currents having reverse directions are respectively applied to the first coil 103*a* and the second coil 103*b* in accordance with the first embodiment of the present invention. Following methods can be considered to apply the currents. First, referring to FIG. 6A, in the case where the first coil 103*a* and the second coil 103*b* are wound in different directions, a start winding contact point 115*a* of the first coil 103*a* and an end winding contact point 116*b* of the second coil 103*b* are connected in series, and a control circuit 150 is connected to an end winding contact point 116*a* of the first coil 103*a* and a start winding contact point 115*b* of the second coil 103*b* so as to apply the current. A description will be given of the control circuit 150 later in detail. With the above-mentioned configuration, the currents I1 and I2 having different directions are applied to the first coil 103*a* and the second coil 103*b* respectively. In contrast, referring to FIG. 6B, in the case where the first coil 103*a* and the second coil 103*b* are wound in the same directions, the start winding contact point 115*a* of the first coil 103*a* and the start winding contact point 115*b* of the second coil 103*b* are connected in series, and the control circuit 150 is connected to the end winding contact point 116*a* of the first coil 103*a* and the end winding contact point 116*b* of the second coil 103*b* so as to apply the current. With the above-mentioned configuration, the currents I1 and I2 having different directions are applied to the first coil 103*a* and the second coil 103*b* respectively. In addition, referring to FIG. 6C, as another example of the case where the first coil 103*a* and the second coil 103*b* are wound in the same directions, the start winding contact point 115*a* of the first coil 103*a* and the end winding contact point 116*b* of the second coil 103*b* are connected in series, and the end winding contact point 116*a* of the first coil 103*a* and the start winding contact point 115*b* of the second coil 103*b* are connected in series, then the control circuit 150 is connected in parallel with respective connected copper wires. With the above-mentioned configuration, the currents I1 and I2 having different directions are applied to the first coil 103*a* and the second coil 103*b* respectively.

As shown in FIGS. 6A through 6C, the description has been given of how the current flows from the control circuit 150 after the connection of the first coil 103*a* and the second coil 103*b*. Mechanisms for applying the currents may be connected to the first coil 103*a* and the second coil 103*b* respectively and individually so that the control circuit 150 may control the mechanisms for applying the currents and adjust the amount of the currents flowing through the coils.

Figure 7A:
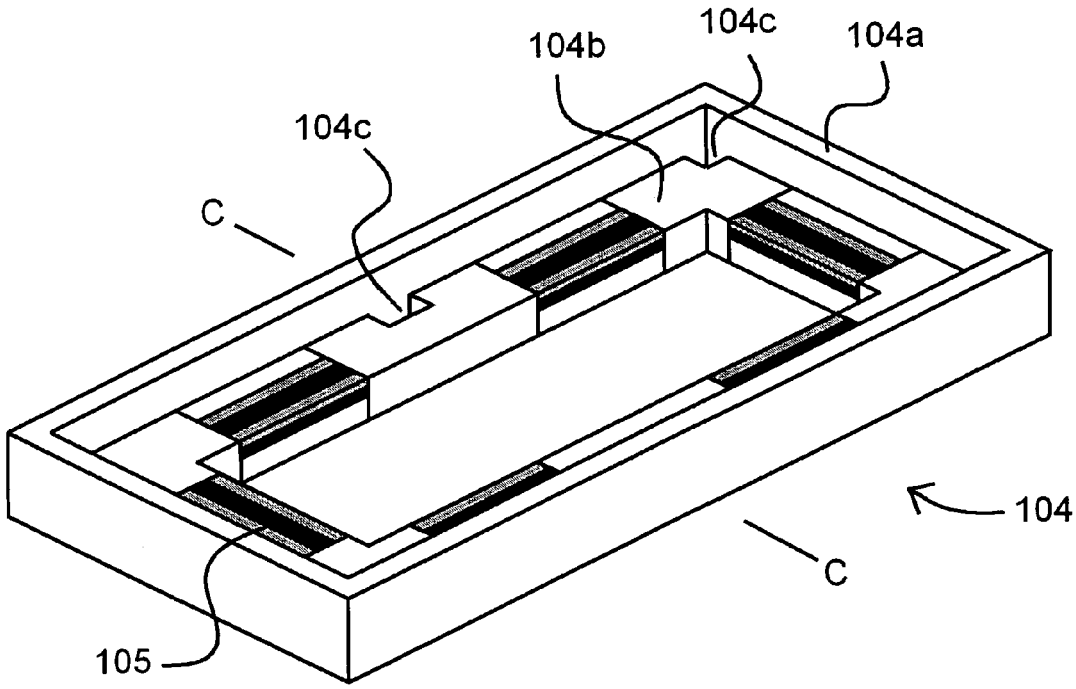
FIG. 7A is a perspective view of the frame-shaped base 104.
Figure 7B:
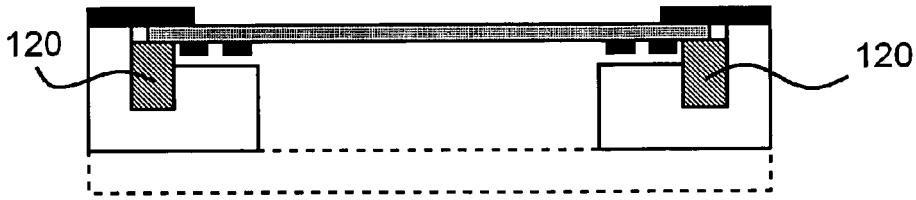
FIG. 7B is a cross-sectional view taken along a line C—C shown in FIG. 7A.

Next, a description will be given of the frame-shaped base 104 shown in FIG. 3 in detail. FIG. 7A is a perspective view of the frame-shaped base 104. FIG. 7B is a cross-sectional view taken along a line C—C shown in FIG. 7A. The frame-shaped base 104 includes a sidewall portion 104*a*, a bottom face portion 104*b*. The sidewall portion 104*a* surrounds the circumference. The bottom face portion 104*b* is formed in a frame shape along the sidewall portion 104*a*. An opening is provided in the center of the bottom face portion 104*b* so as to show the display device (not shown). The bottom face portion 104*b* has multiple dents 104*c*, into which the magnetic field generating mechanism 105 and a spacer material (which will be described later) are fit. Referring to FIG. 7B, the multiple dents 104*c* are provided on the sidewall portion 104*a* of the bottom face portion 104*b* so that a spacer member 120 having a given size may be fit thereinto, without leaving a space. The spacer member is made of, for example, rubber or foam. The spacer member 120 is used for preventing the coil portion 103 and the bottom face portion 104*b* from getting into contact with each other and for suppressing a generation of unnecessary operation sounds, when the touch panel 120 is lifted up and down repeatedly. Also, the spacer portion 120 is formed slightly higher than a top face of the bottom face portion 104*b* and is contact with a bottom face of the touch panel 102.

Figure 8A:
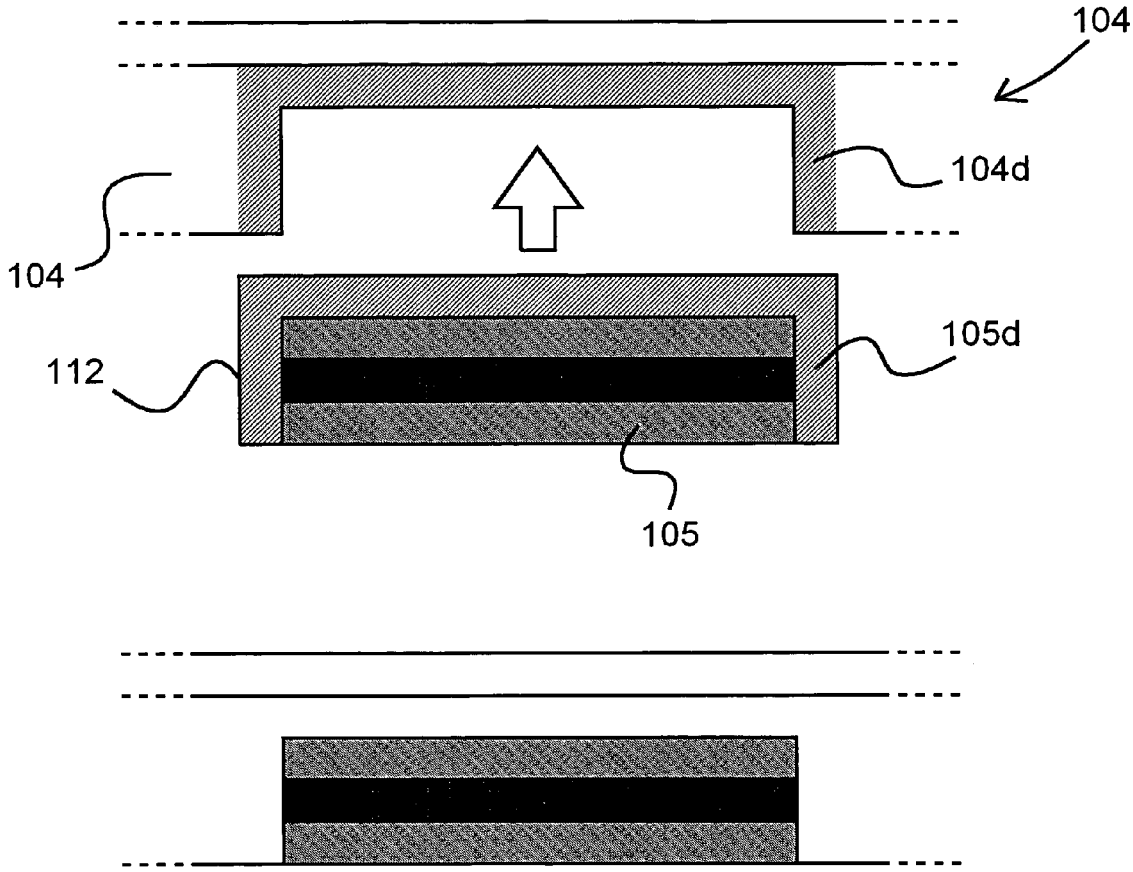
FIGS. 8A and 8B sow an example of how to attach the magnetic field generating mechanism 105 to the frame-shaped base 104 in accordance with the first embodiment of the present invention.
Figure 8B:
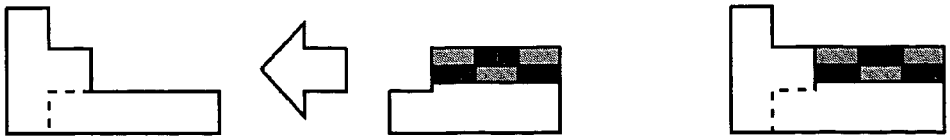

FIGS. 8A and 8B show an example of how to attach the magnetic field generating mechanisms 105 to the frame-shaped base 104. The magnetic field generating mechanism 105 in accordance with the first embodiment of the present invention includes the yoke 112 and an attaching face 105*d*. The yoke 112 is formed slightly larger than a total area occupied by the three magnets 111*a*, 111*b*, and 111*c*. The attaching face 105*d* is provided on a top face of the yoke 112. On the other hand, an attaching depression portion 104*d* is provided on the bottom face portion 104*b* of the frame-shaped base 104. The attaching depression portion 104*d* corresponds to the shape of the above-mentioned yoke 112. An epoxy resin adhesive, for example, is laminated on the attaching face 105*d* of the magnetic field generating mechanism 105 so as to bong together with the attaching depression portion 104*d*. In addition, instead of bonding, the attaching depression portion 104*d* and the yoke 112 may accurately be adjusted so that the magnetic field generating mechanisms 105 may be pressed and fit into the attaching depression portion 104*d* and the yoke 112. The above-mentioned attaching method, it is possible to form the magnetic field generating mechanism 105 in the frame-shaped base 104 with high accuracy. As shown in FIGS. 8A and 8B, the frame-shaped base 104 and the magnetic field generating mechanism 105 are illustrated as individual parts; however, the three magnets 111*a*, 111*b*, and 111*c* may be attached to the bottom face portion 104*b* of the frame-shaped base 104 accurately by bonding or the like.

Figure 9A:
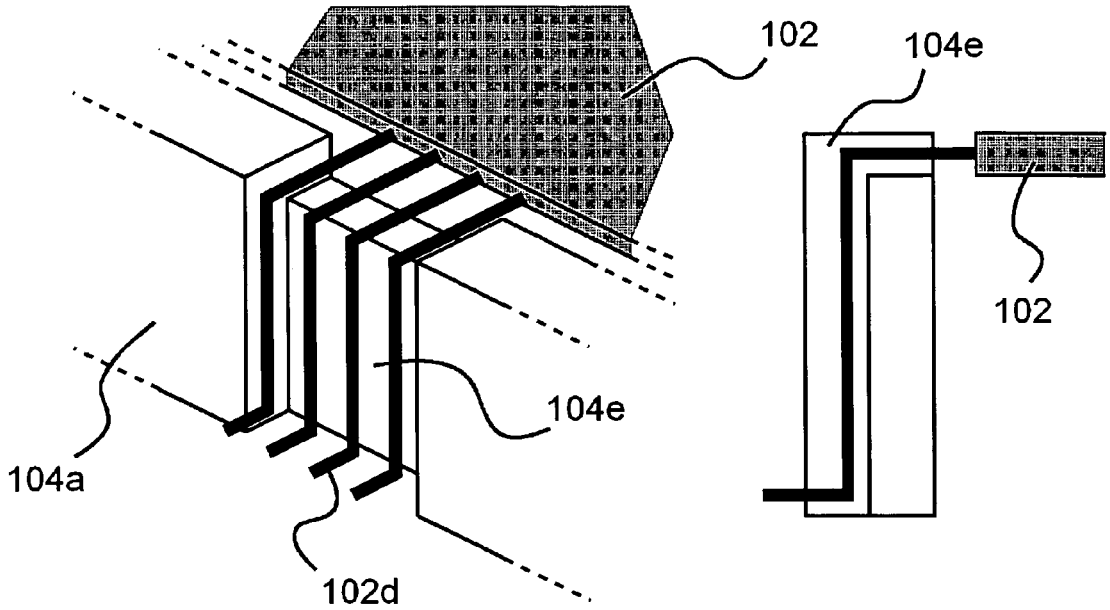
FIGS. 9A and 9B illustrate an example of how to electrically connect electrode wires in accordance with the first embodiment of the present invention.
Figure 9B:
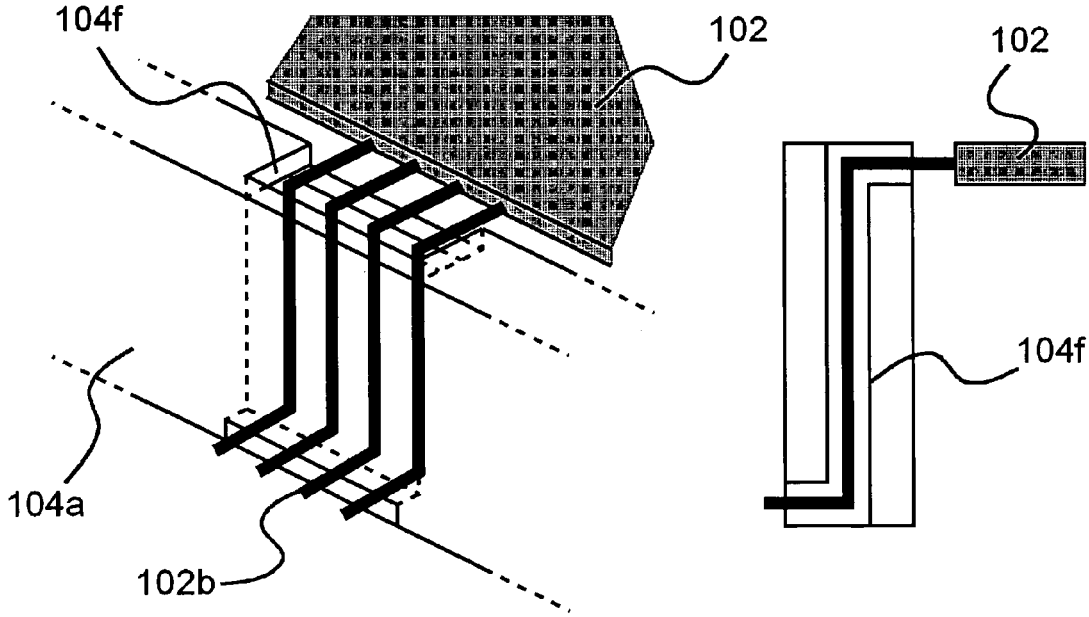

Next, FIGS. 9A and 9B illustrate an example of how to electrically connect electrode wires in accordance with the first embodiment of the present invention. Referring to FIG. 9A, the sidewall portion 104*a* of the frame-shaped base 104 includes an electrode wire guiding depression portion 104*e*. The touch panel 102 has electrode wires 102*d*, which are wired along the shape of the electrode wire guiding depression portion 104*e*. Here, the electrode wires 102*b* are held by a securing member (not shown) not to come off from the electrode wire guiding depression portion 104*e*, or the electrode wires 102*b* are bonded together with the electrode wire guiding depression portion 104*e* by, for example, the two-sided tape or adhesive, with an appropriate slack to the extent that an excessive tension is not generated, while the touch panel is being lifted up and down. Referring to FIG. 9B, electrode guiding through-bores 104*f* may be provided in the sidewall portion 104*a*. Here, the electrode wires 102*d* of the touch panel 102 are connected to the outside of the frame-shaped base 104 through the electrode guiding through-bores 104*f*. Therefore, the electrode wires 102*b* need not to be secured. In the same manner, coil electrode through-bores are provided on the sidewall portion 104*a* so that the coils provided inside the frame-shaped base 104 and external power units may be kept connected.

Figure 10:
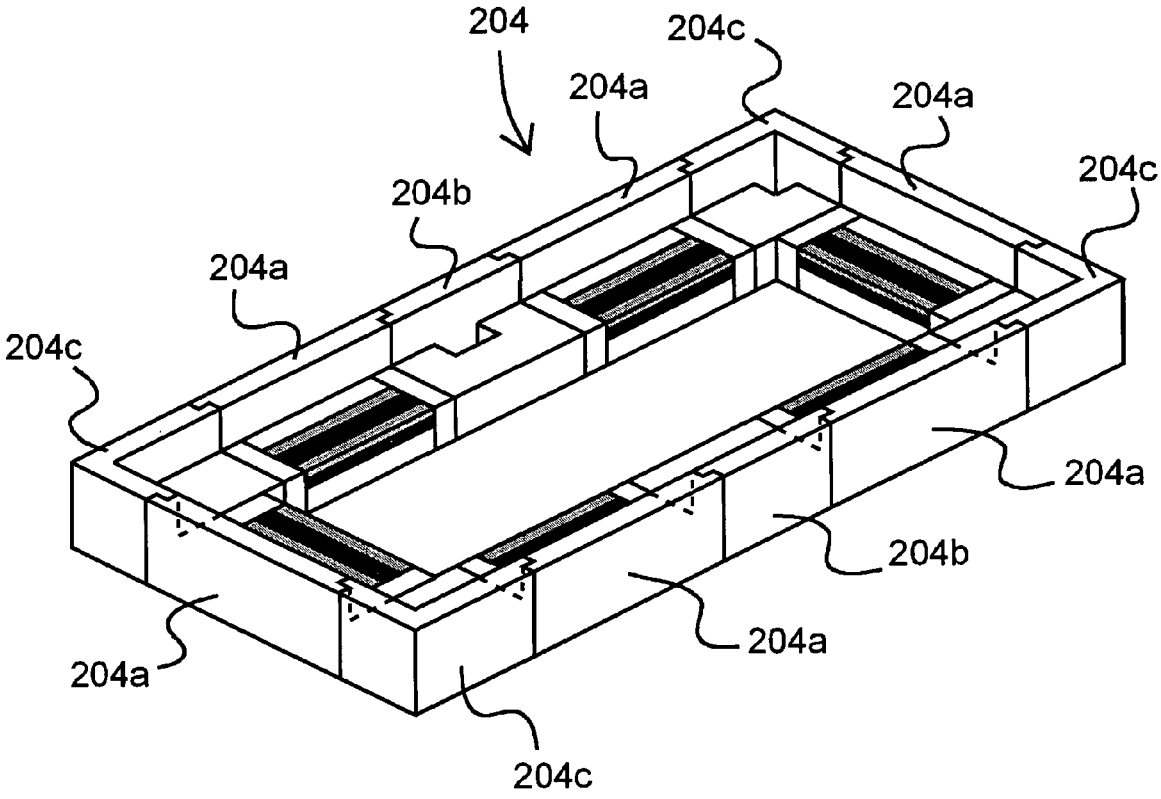
FIG. 10 is a perspective view of the variation example of a frame-shaped base 204 in accordance with the first embodiment of the present invention.

Next, a description will be given of a variation example of the frame-shaped base in accordance with the first embodiment of the present invention. FIG. 10 is a perspective view of the variation example of a frame-shaped base 204. The frame-shaped base 204 includes magnet assembling members 204*a*, adjustment assembling members 204*b*, and corner assembling members 204*c*. The magnet assembling members 204*a* include the magnetic field generating mechanisms 105. The adjustment assembling members 204*b* adjust the total length of long and short sides of the frame-shaped base 204. The corner assembling members 204*c* make up four corners of the frame-shaped base 204. The magnet assembling members 204*a*, the adjustment assembling members 204*b*, and the corner assembling members 204*c* are respectively connected by fitting or bonded together by, for example, the two-sided tape or adhesive. With the above-mentioned frame-shaped base 204, it is possible to correspond to a desired size of the touch panel, by arbitrarily adjusting the lengths of the adjustment assembling members 204*b*. In the case where multiple magnet assembling members 204*a* are employed, all the sizes and shapes may be common. This makes it possible to reduce the production cost of the frame-shaped base 204.

Figure 11A:
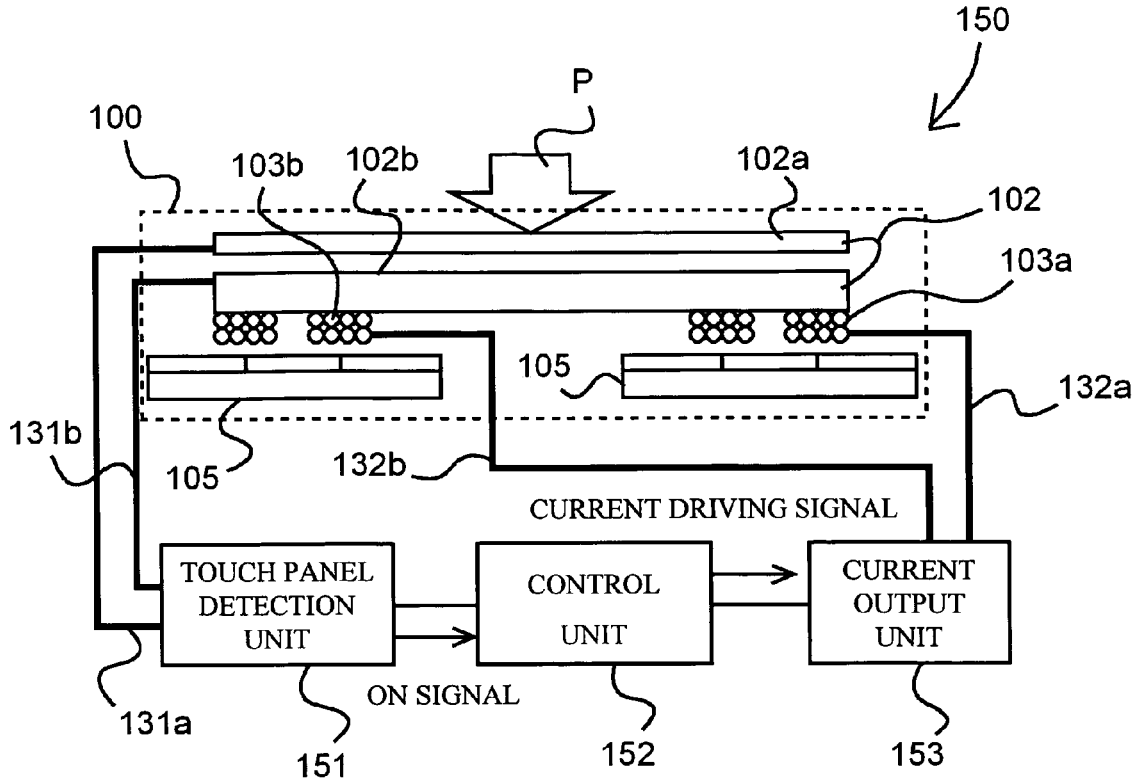
FIG. 11A is a block diagram of the control circuit 150 of the plane plate vibration device 100 in accordance with the first embodiment of the present invention.
Figure 11B:
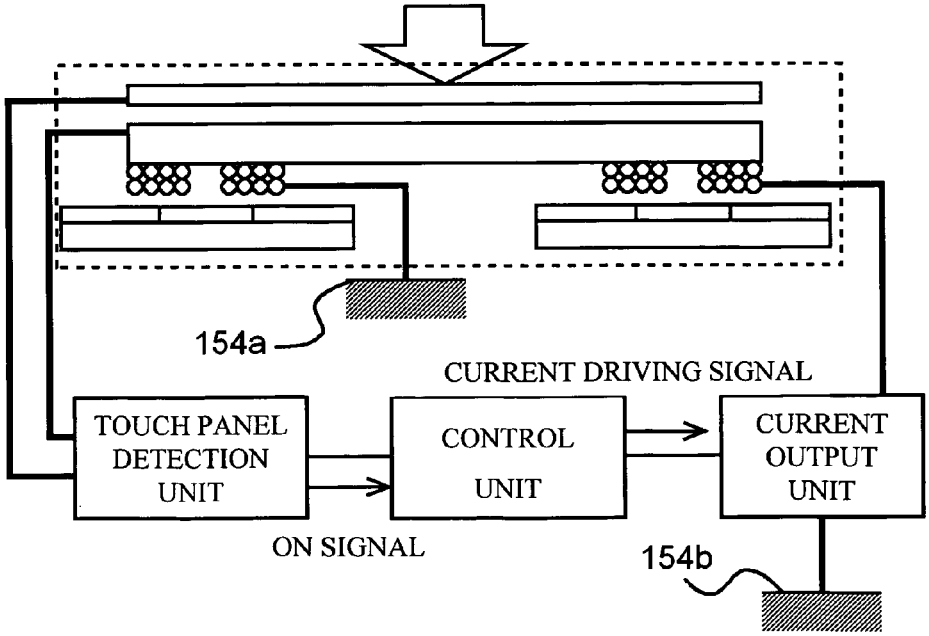
FIG. 11B is a variation example of the control circuit 150.

Next, a description will be given of the control circuit of the plane plate vibration device in accordance with the first embodiment of the present invention. FIG. 11A is a block diagram of the control circuit 150 of the plane plate vibration device 100 in accordance with the first embodiment of the present invention. The control circuit 150 includes a touch panel detection unit 151, a control unit 152, and a current output unit 153. The touch panel detection unit 151 is electrically coupled to an top face 102*a* and a bottom face 102*b* of the touch panel 102 respectively through panel electrode wires 131*a* and 131*b*. The touch panel detection unit 151 is also electrically coupled to the control unit 152. The touch panel detection unit 151 inputs electronic signals representing information such as a position that has been detected as an input (an arrow P) entered by, for example, a finger or a pen on the touch panel 102, and outputs an ON signal according to the position to the control unit 152. The control unit 152 is electrically connected to the touch panel detection unit 151 and the current output unit 153. The control unit 152 outputs a current-steered signal to the current output unit 153, according to the ON signal applied from the touch panel detection unit 151. The current-steered signal makes a given current such as a pulse shape or a triangle waveform flow through the coil portion 103. Additionally, the control unit 152 also includes a memory (not shown), which stores a given current waveform pattern or the like that corresponds to the ON signal applied from the touch panel detection unit 151. The current output unit 153 is electrically coupled to the first coil 103*a* and the second coil 103*b* respectively via coil electrode wires 132*a* and 132*b*. The current output unit 153 makes the current flow through the first coil 103*a* and the second coil 103*b*. The above-mentioned current has a waveform and strength corresponding to the current-steered signal applied from the control unit 152. With the above-mentioned control circuit, it is possible to make the current according to the input information of the touch panel 102 flow through the first coil 103*a* and the second coil 103*b*. This makes it possible to change up-and-down movements of the touch panel 102 in various desirable patterns. As a variation example of the control circuit 150, with reference to FIG. 11B, the current output unit 153 may be configured to connect an end of the coil to the coil electrode wire 132*a* and to connect another end of the coil to earths 154*a* and 154*b*.

With the above-mentioned configuration and operation, with reference to FIGS. 5 and 6, the plane plate vibration device 100 in accordance with the first embodiment of the present invention is capable of making the reverse currents flow through the first coil 103*a* and the second coil 103*b* provided in the magnetic field having different directions, and is capable of generating the forces, according to the Fleming's law, in the two coils in the same direction so that the touch panel 102 to which the coils are secured may move upward and downward in a desirable manner.

The plane plate vibration device 100 in accordance with the first embodiment of the present invention includes the first coil 103*a*, the second coil 103*b*, and the magnetic field generating mechanism 105 having the three magnets 111*a*, 111*b*, and 111*c* generating magnetic fields of different directions. The number of the coils may be three or more. In this case, the forces are adjusted to apply to the respective coils in the same direction according to the Fleming's law, with reference to the directions of the currents flowing through the three or more coils and the directions of the magnetic fields in which the three or more coils are arranged. Preferably, the directions of the current flowing through adjacent coils are reverse, and polarities of the pole faces that correspond to the top faces of adjacent magnets are also reverse.

With the plane plate vibration device 100 in accordance with the first embodiment of the present invention, the coils and the magnetic field generating mechanism vibrate the whole touch panel. It is thus possible to make a vibrating movement with a large stroke of several millimeters.

In addition, in the plane plate vibration device 100 in accordance with the first embodiment of the present invention, it is possible to change the sizes of the frame-shaped base and the coils arbitrarily, and furthermore; any additional mechanical structure is unnecessary to make the touch panel move up and down. It is thus possible to be downsized.

Further, the plane plate vibration device 100 in accordance with the first embodiment of the present invention is capable of applying the current having a desirable waveform and strength to the coils according to the input information applied from the touch panel. It is thus possible to generate desirable sounds according to the vibration of the touch panel.

The preferred embodiment has been described above; however, the present invention is not limited to the above-mentioned embodiment, and other embodiments, variations and modifications may be made without departing from the scope of the present invention. For example, the description has been given of the touch panel as an example of the input device; however, the present invention includes the case where an optical switch, an electrostatic switch, or a piezoelectric switch is included. The optical switch senses a finger or the like with an optical sensor or the like and outputs the input signals. The electrostatic switch outputs on and off signals according to the differences in electric capacitance when the top face of the touch panel is pushed down. The piezoelectric switch converts a pressure into an electric signal, the pressure being generated when the top face of the touch panel is pushed down.

The present invention is based on Japanese Patent Application No. 2004-037409 filed on Feb. 13, 2004, the entire disclosure of which is hereby incorporated by reference.

What is claimed is:

1. A plane plate vibration device comprising:

a plane plate;

a coil portion having a first coil and a second coil, the first coil being wound on a circumference of the plane plate in parallel with the plane plate, the second coil being wound along inside of the first coil in parallel with the plane plate; and magnetic field generating mechanisms that are provided in parallel with the plane plate and generate magnetic fields in directions perpendicular to directions of currents respectively flowing through the first coil and the second coil, wherein:

the currents flow through the first coil and the second coil in reverse directions;

the directions of magnetic fields perpendicular to the currents respectively flowing through the first coil and the second coil give forces in the same direction; and the plane plate vibrates in a direction of thickness by adjusting the currents respectively flowing through the first coil and the second coil.

2. The plane plate vibration device as claimed in claim 1, wherein the first coil and the second coil are wound in the reverse directions.

3. The plane plate vibration device as claimed in claim 1, wherein:

the first coil and the second coil are wound in the same direction; and the first coil and the second coil are electrically coupled either in series or in parallel to apply the reverse directions of the currents respectively.

4. The plane plate vibration device as claimed in claim 1, wherein the coil portion includes at least two coils wound on the circumference of the plane plate in parallel with the plane plate.

5. The plane plate vibration device as claimed in claim 4, wherein:

said at least two coils are arranged alternately in the reverse directions; and the currents flowing through said at least two coils have reverse directions.

6. The plane plate vibration device as claimed in claim 4, wherein:

said at least two coils are wound in the same direction; and said at least two coils are electrically connected either in series or in parallel to have the reverse directions of the currents alternately.

7. The plane plate vibration device as claimed in claim 1, wherein the coils included in the coil portion are arranged either at given intervals or in very close contact with an adjacent coil.

8. The plane plate vibration device as claimed in claim 1, wherein:

each of the magnetic field generating mechanisms comprises three magnets and a yoke;

each of the three magnets has a plane shape and two pole faces are provided on a top face and a bottom face; and the three magnets are secured in contact with the yoke so that the pole faces of top faces alternately have different polarities.

9. The plane plate vibration device as claimed in claim 4, wherein:

each of the magnetic field generating mechanisms comprises at least three magnets and a yoke;

each of said at least three magnets has a plane shape and two pole faces are provided on a top face and a bottom face; and the three magnets are secured in contact with the yoke so that the pole faces of top faces alternately have different polarities.

10. The plane plate vibration device as claimed in claim 8, wherein the yoke is made of a magnetic substance.

11. The plane plate vibration device as claimed in claim 1, further comprising:

a frame-shaped base including the magnetic field generating mechanisms; and a fixing member fixing the plane plate.

12. The plane plate vibration device as claimed in claim 11, wherein:

the fixing member is made of an elastic body and is provided either fully or partially on a circumference of the plane plate; and a bottom face of the fixing member is secured to a top face of the plane plate and a top face of the frame-shaped base.

13. The plane plate vibration device as claimed in claim 11, wherein:

the fixing member is made of an elastic body and provided fully on a circumference of the plane plate; and a bottom face of the fixing member is secured to a top face of the plane plate and a top face of the frame-shaped base with a water-resistance adhesive.

14. The plane plate vibration device as claimed in claim 11, wherein the fixing member is connected to a part of a chassis through a water-resistant member, the chassis housing the plane plate vibration device.

15. The plane plate vibration device as claimed in claim 1, wherein:

the coil portion is secured to the plane plate; and the magnetic field generating mechanisms are arranged at a given interval with the plane plate.

16. The plane plate vibration device as claimed in claim 15, wherein the given interval is given on a region by providing multiple spacer members, the region excluding a space between either the coil portion or the plane plate and the magnetic field generating mechanisms.

17. The plane plate vibration device as claimed in claim 16, wherein:

the spacer members are made of elastic bodies; and the frame-shaped base has a depression portion to hold the spacer members.

18. The plane plate vibration device as claimed in claim 1, wherein the frame-shaped base houses the plane plate and the coil portion therein, and has at least one through-bore to connect an electrode wire extending from the coil portion to outside.

19. The plane plate vibration device as claimed in claim 1, further comprising:

a frame-shaped base that comprises the magnetic field generating mechanisms having a yoke; and a fixing member that fixes the plane plate;

wherein:

the frame-shaped base and the magnetic field generating mechanisms are formed as different parts;

an attaching dent is provided on the frame-shaped base to correspond to a size of the yoke of the magnetic field generating mechanisms, and the attaching dent is either adhered to or fit into the yoke of the magnetic field generating mechanisms.

20. The plane plate vibration device as claimed in claim 19, wherein:

the frame-shaped base comprises a magnet assembling members, corner assembling members, and adjustment assembling members, the magnet assembling members including the magnet field generating mechanisms, the corner assembling members forming corners of the frame-shaped base, the adjustment assembling members connecting the magnet assembling members and the corner assembling members; and the frame-shaped base is formed in a desirable size, by adjusting lengths of the adjustment assembling members to adjust lengths of four sides of the frame-shaped base.

21. A touch panel comprising:

a plane plate outputting a signal indicating coordinates of a touched position;

a coil portion having a first coil and a second coil, the first coil being wound on a circumference of the plane plate in parallel with the plane plate, the second coil being wound along inside of the first coil in parallel with the plane plate; and magnetic field generating mechanisms that are provided in parallel with the plane plate and generate magnetic fields in directions perpendicular to directions of currents respectively flowing through the first coil and the second coil, wherein:

the currents flow through the first coil and the second coil in reverse directions;

the directions of magnetic fields perpendicular to the currents respectively flowing through the first coil and the second coil give forces in the same direction; and the plane plate vibrates in a direction of thickness by adjusting the currents respectively flowing through the first coil and the second coil.

22. The touch panel as claimed in claim 21, wherein the plane plate has a vibration based on a touch position indicated by the signal output by the plane plate.

23. The touch panel as claimed in claim 21, wherein:

the plane plate has a vibration based on a touch position indicated by the signal output by the plane plate; and the vibration creates a sound for confirming a touch input.

24. A switch comprising:

a plane plate;

a coil portion having a first coil and a second coil, the first coil being wound on a circumference of the plane plate in parallel with the plane plate, the second coil being wound along inside of the first coil in parallel with the plane plate;

magnetic field generating mechanisms that are provided in parallel with the plane plate and generate magnetic fields in directions perpendicular to directions of currents respectively flowing through the first coil and the second coil; and a sensor sensing a touch of an object, wherein:

the currents flow through the first coil and the second coil in reverse directions;

the directions of magnetic fields perpendicular to the currents respectively flowing through the first coil and the second coil give forces in the same direction; and the plane plate is vibrated in a direction of thickness in response to the touch sensed by the sensor.

* * * * *